US005320555A

United States Patent [19]

Okabe

[11] Patent Number: 5,320,555

[45] Date of Patent: Jun. 14, 1994

[54] MODULE TYPE CONNECTOR ASSEMBLY

[75] Inventor: Toshiaki Okabe, Shizuoka, Japan

[73] Assignee: Yazaki Corporation, Japan

[21] Appl. No.: 12,402

[22] Filed: Feb. 2, 1993

[30] Foreign Application Priority Data

Feb. 6, 1992 [JP] Japan ..... 4-004249[U]

[51] Int. Cl.[5] ..... H01R 13/627

[52] U.S. Cl. ..... 439/354; 439/701

[58] Field of Search ..... 439/284, 717, 718, 345, 439/350, 357, 701, 689

[56] References Cited

U.S. PATENT DOCUMENTS 4,997,386 3/1991 Kawachi et al. ..... 439/352
5,122,077 6/1992 Maejima et al. ..... 439/701 X
5,154,630 10/1992 Kamono et al. ..... 439/352

FOREIGN PATENT DOCUMENTS 62-191171 12/1987 Japan .

*Primary Examiner*—Khiem Nguyen
*Attorney, Agent, or Firm*—Wigman, Cohen, Leitner & Myers

[57] ABSTRACT

Disclosed is a connector assembly, which includes a plurality of male housing modules which are separable from each other and attached together to form a male housing unit; and a female housing adapted to receive the male housing unit to be inserted into the female housing. Each of the male housing modules has at least one male housing module's terminal, and the female housing has female housing's terminals each of which is to be electrically connected with one of the male housing module's terminals of the male housing modules. The connector assembly has a locking mechanism for releasably locking the male housing unit with respect to the female housing, and the locking means is mounted on an outermost one of the male housing modules. Moreover, the connector assembly comprises a holding mechanism for tightly holding the outermost one of the male housing modules with respect to another one of the male housing modules attached adjacent to the outermost one of the male housing modules. The holding mechanism holds a portion of the outermost one of the male housing modules at which the locking mechanism is mounted on the outermost one of the male housing modules, and reinforces the mounted portion of the outermost housing module against a force applied through the locking mechanism.

14 Claims, 6 Drawing Sheets

MODULE TYPE CONNECTOR ASSEMBLY

BACKGROUND OF THE INVENTION

1. Field of the Invention

The present invention relates to a connector assembly comprising a couple of a male connector and a female connector and, in particular, to a module type connector assembly wherein a male connector comprises a plurality of male housing modules which are superposed and attached together to form a unified male connector, and housings contain a plurality of terminal receptacles arranged in parallel.

2. Description of the Prior Art

In the field of connectors, various types of connector assemblies have been known. However, description will be referred specifically to the art of a module type connector assembly for explanation of back ground of the present invention. As an example of the conventional module type connector, FIGS. 1 through 3 show a press-contact connector assembly which has been proposed by the present inventor and disclosed in Japanese Utility Model Prepublication No. 191171/1987.

As shown in FIG. 1, the press-contact connector assembly comprises a female connector 1 and a male connector 3 which is fitted into the female connector and put into a locked state. The male connector 3 comprises two laminar housings 5 and 7, and the housings 5 and 7 are superposed and unified into one male connector by engagement between coupling portions 9 and 11, as shown in FIG. 2. Each of the housings 5 and 7 has a plurality of terminal receptacles 13 for accommodating female terminals 15, as shown in FIG. 3, and the terminal receptacles 13 are arranged in parallel in the housings to form a single layer. In the forward part of each terminal receptacle 13, a cavity 17 is formed to receive an electrical contact 19 of the female terminal 15.

The housing 5, which is an uppermost layer of the male connector 3, is provided with a flexible rocking arm 21 as shown in FIG. 2. The rocking arm 21 is integrally connected to a base plate 23 of the housing 5 through a support portion 25 and extends along an upper surface 23*a* of the base plate 23. An engagement projection 27 and a press protrusion 29 are formed on an upper surface 21*a* of the rocking arm 21.

According to the above configuration, when the male connector 3 of the above-described structure is fitted in a coupling hood 31 of the female connector 1, male terminals (not shown) of the female connector 1 are inserted into the electrical contacts 19 of the female terminals 15 to establish electrical connection therebetween. At the same time, the engagement projection 27 of the male connector 3 is engaged with an engagement portion 33 of the female connector 1 to lock the connectors 1 and 3 to one another. In order to disconnect the connectors 1 and 3, the press protrusion 29 is pressed to bend the rocking arm 21. Consequently, the engagement projection 27 is released from the engagement portion 33 to thereby unlock the connectors 1 and 3.

In the above configuration, if it is aimed to reduce the size of the male connector 3, it is required to decrease a whole height H and a thickness h of the base plate 23 supporting the rocking arm 21. However, the base plate 23 of a reduced thickness inevitably has an insufficient strength. As a result of this, if the press protrusion 29 is pressed down to unlock the connectors 1 and 3, the base plate 23 can not bear a force which is concentratedly applied through the support portion 25, and the base plate 23 is deformed and floats up. Consequently, the engagement projection 27 is prevented from being released. In order to cope with the above problem, as illustrated in FIG. 1, a tip end 21*b* opposite to the support portion 25 of the rocking arm 21 is fixedly attached to the housing 5, and the rocking arm 21 is supported at both ends thereof so as to alleviate the force applied to the base plate 23 and the support portion 25.

However, such a rocking arm 21 as being supported at both ends is difficult to be bent as compared with that supported only by the support portion 25. Therefore, unlocking operation is not easily carried out, and this results in deterioration of a working efficiency.

SUMMARY OF THE INVENTION

Therefore, it is an object of the present invention to provide a module type connector assembly which is capable of readily releasing the engagement between male and female connectors and which is adaptable for reduction in size.

In order to achieve the above-mentioned object, a connecter assembly according to the present invention comprises: a plurality of male housing modules which are separable from each other and attached together to form a male housing unit, each of the male housing modules having at least one male housing module terminal; a female housing adapted to receive the male housing unit to be inserted into the female housing, the female housing having female housing terminals to be electrically connected with said at least one male housing module terminal of said each of the male housing modules; locking means for releasably locking the male housing unit with respect to the female housing, the locking means being mounted on an outermost one of the male housing modules; and holding means for tightly holding the outermost one of the male housing modules with respect to another one of the male housing modules attached adjacent to the outermost one of the male housing modules.

The holding means can holds a portion of the outermost one of the male housing modules at which the locking means is mounted on the outermost one of the male housing module.

Moreover, said mounted portion of the outermost male housing module can be located at a substantially central portion of the outermost one of the male housing modules.

With the above-mentioned structure, the holding means serves to tightly hold the outermost male housing module on the adjacent male housing module against the force concentratedly applied to the mounted portion to prevent from being floated up due to deformation. According to this construction, any other device is not required. Therefore, easy operation of the locking means is never inhibited, and unlock operation is easily carried out.

BRIEF DESCRIPTION OF THE DRAWINGS

The features and advantages of the connector assembly according to the present invention will be more clearly understood from the following description of the preferred embodiments of the present invention taken in conjunction with the accompanying drawings in which identical reference numerals designate the same or similar elements or sections throughout the figures thereof and in which.

DETAILED DESCRIPTION OF THE PREFERRED EMBODIMENTS

Figure 1:
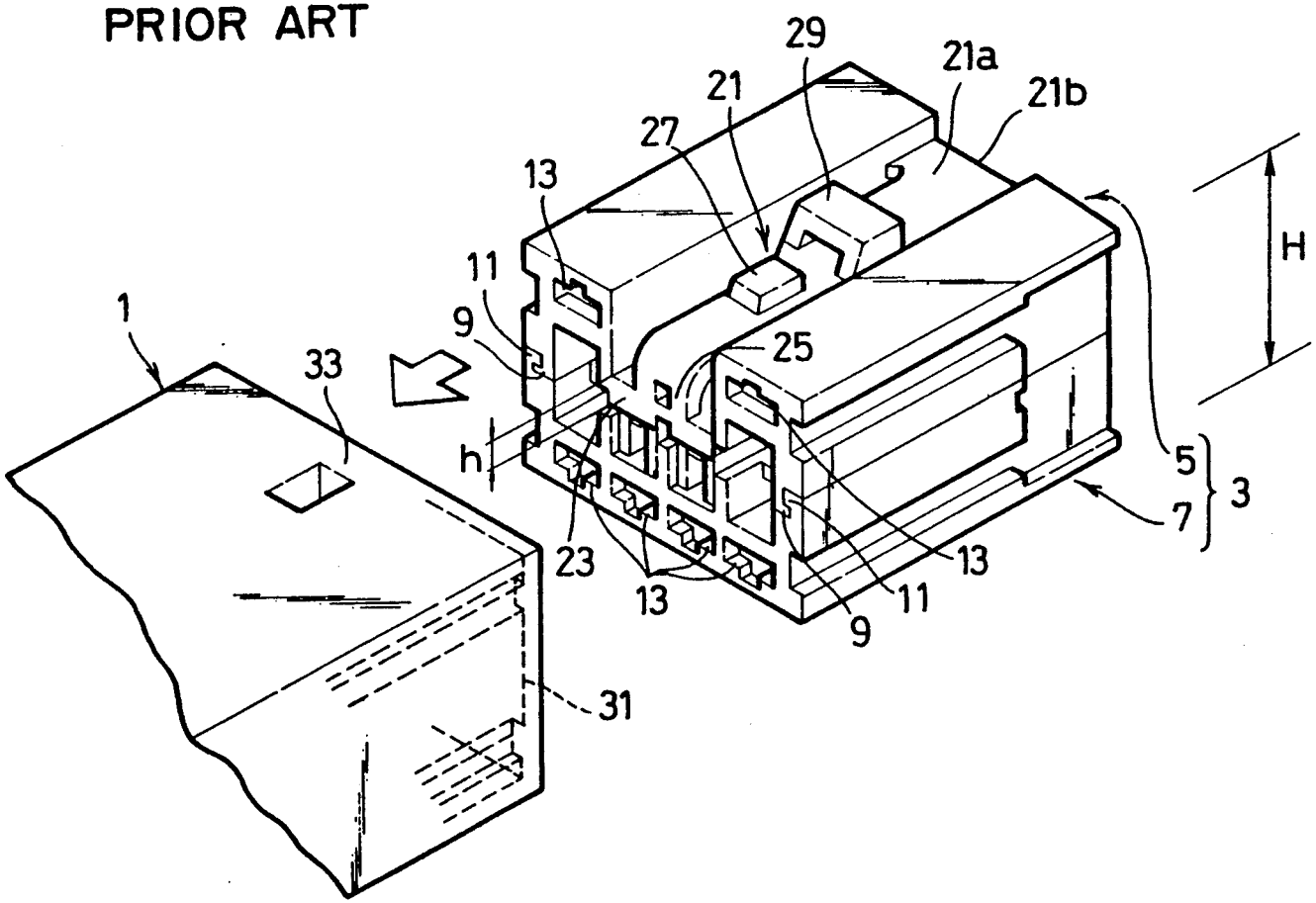
FIG. 1 PRIOR ART
FIG. 1 is a perspective view showing a conventional connector.
Figure 2:
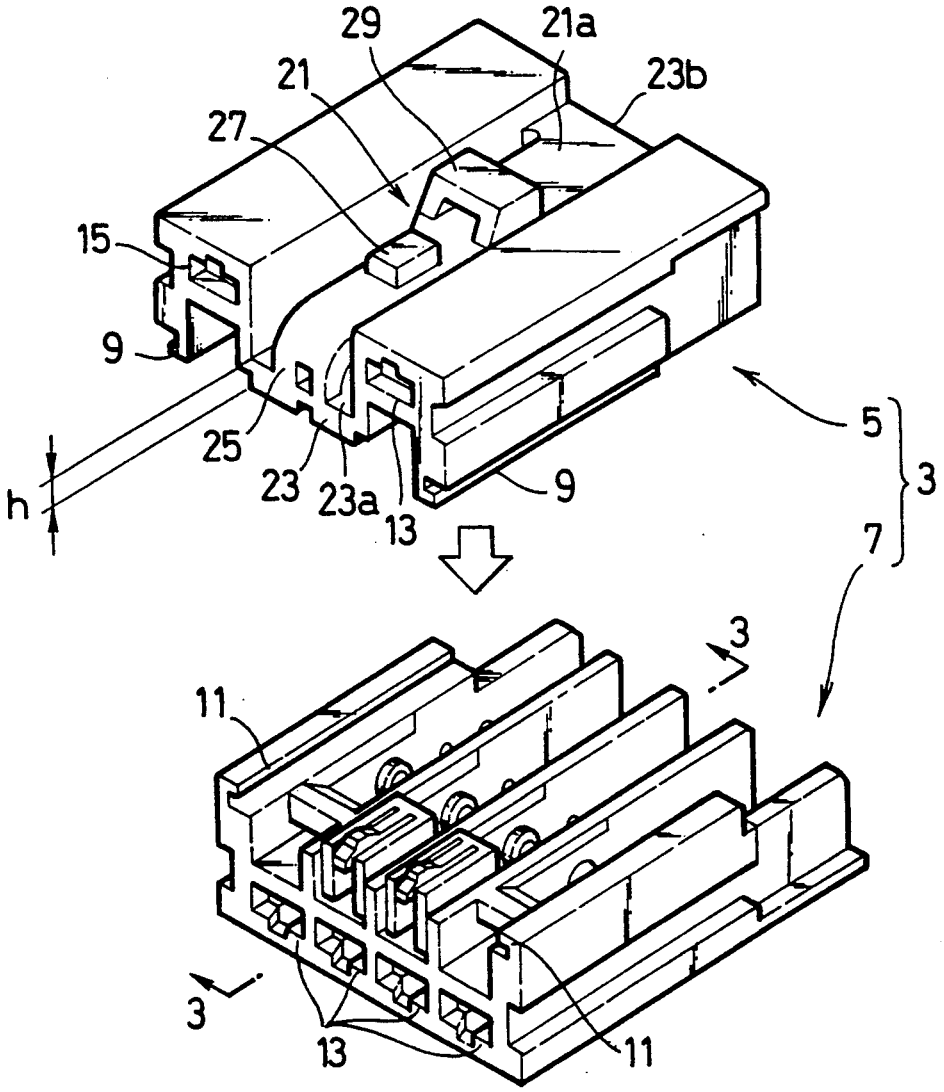
FIG. 2 PRIOR ART
FIG. 2 is a perspective view for explanation of unification of the conventional connector illustrated in FIG. 1.
Figure 3:
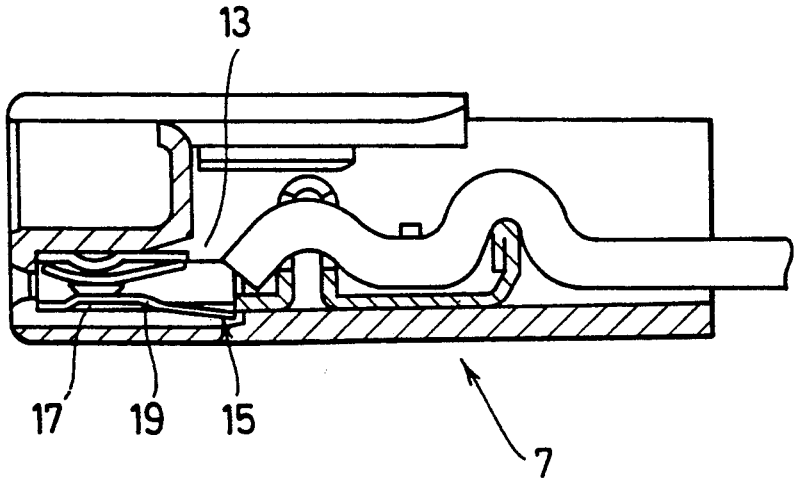
FIG. 3 PRIOR ART
FIG. 3 is a sectional view of the conventional connector taken along a line 3—3 in FIG. 2.

Referring now to the drawings, a preferred embodiment of the connector assembly according to the present invention will be explained.

Figure 4:
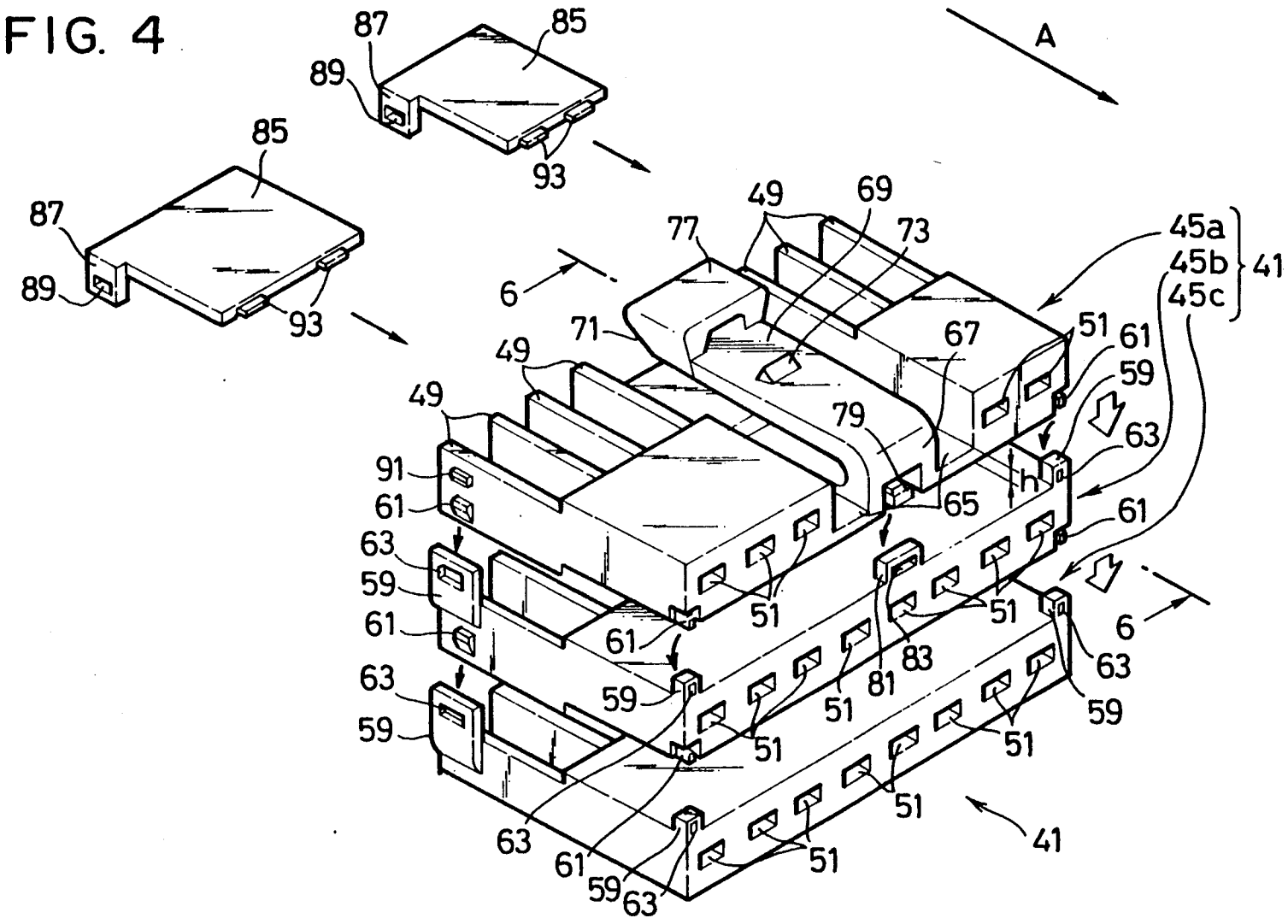
FIG. 4 is a perspective view showing a laminar housing modules of a connector assembly according to the present invention.
Figure 5:
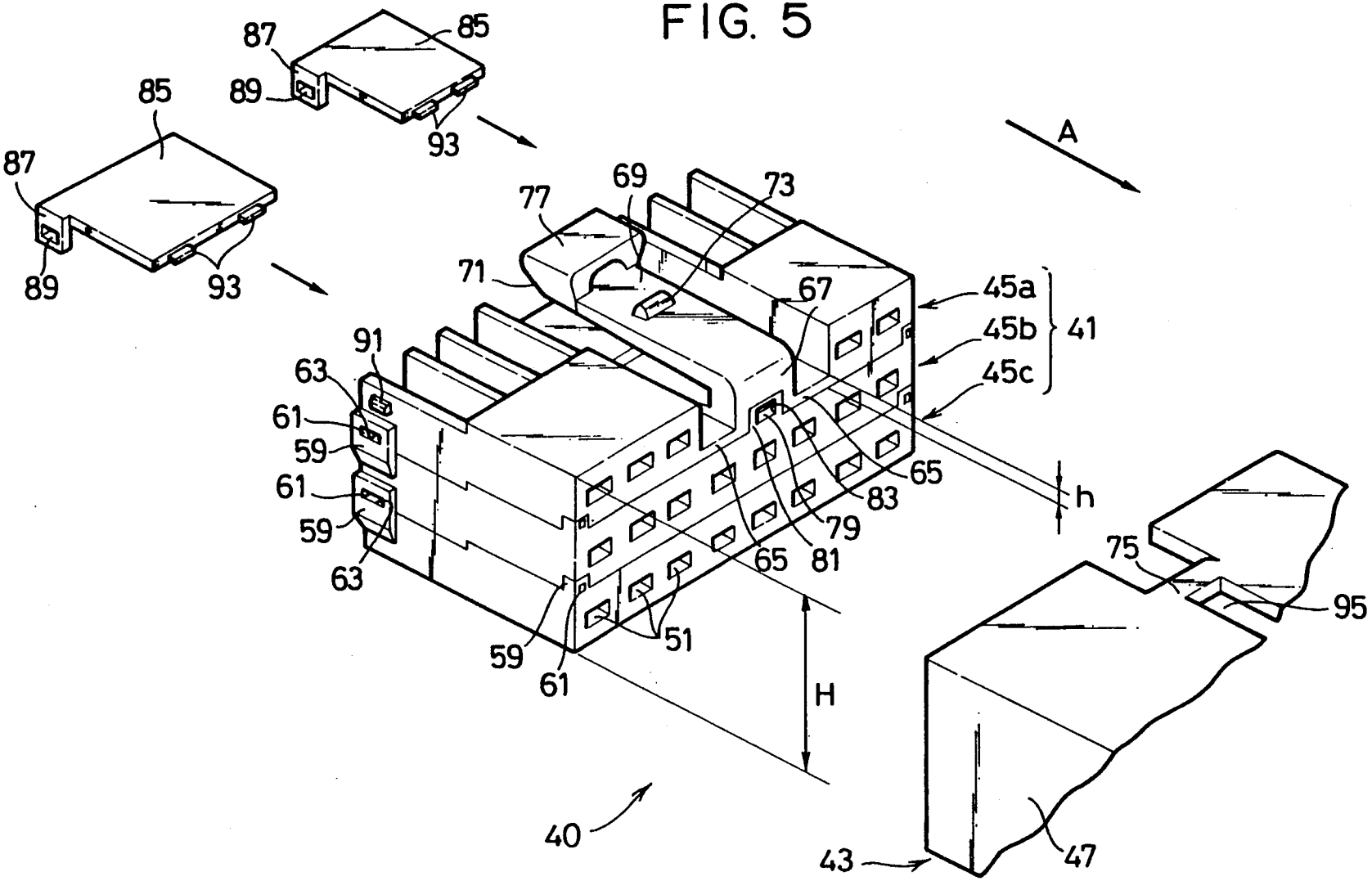
FIG. 5 is a perspective view showing unification of the housing modules of the connector assembly illustrated in FIG. 4.
Figure 6:
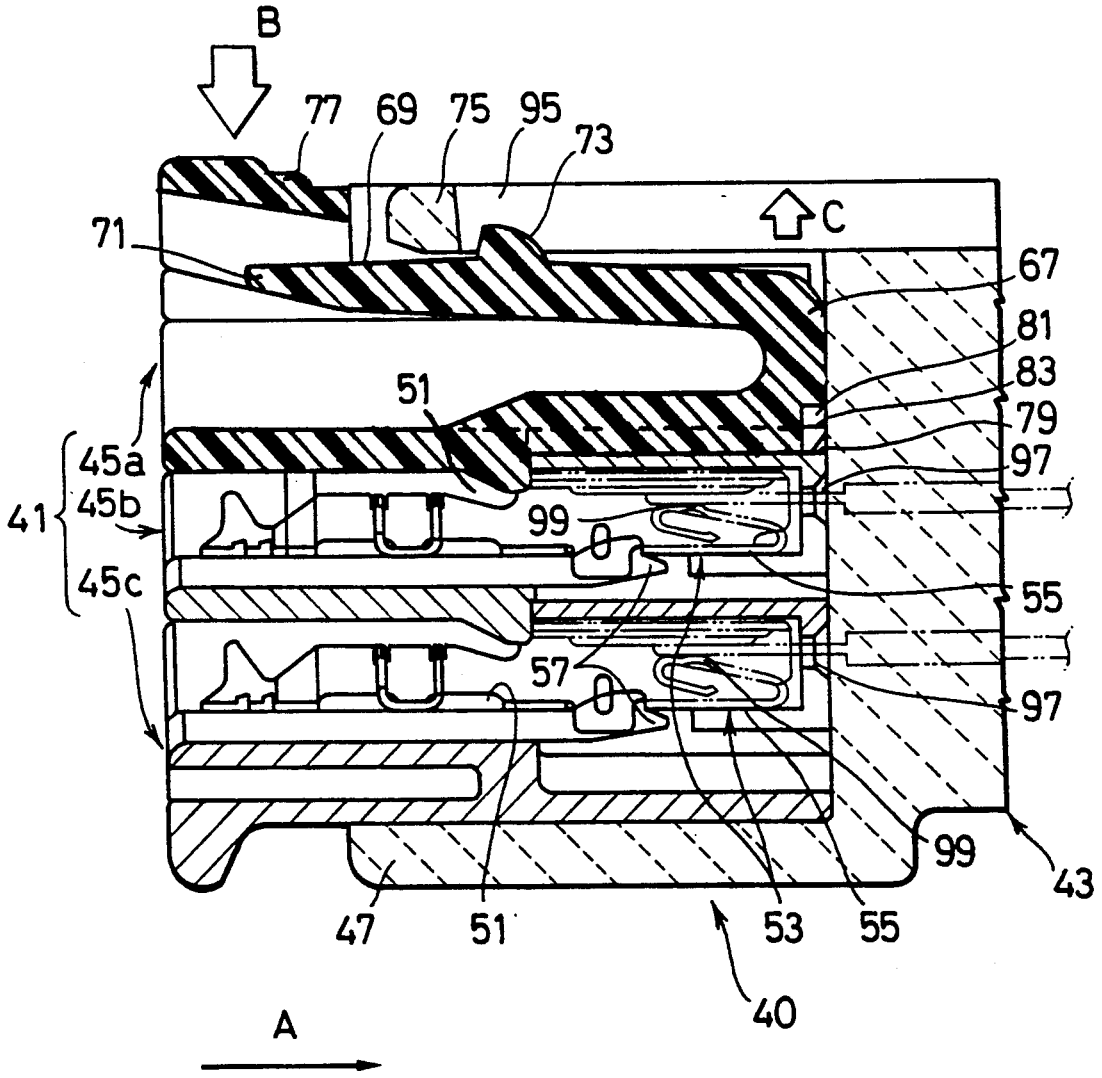
FIG. 6 is a sectional view of the connector assembly taken along a line 6—6 in FIG. 4.

FIGS. 4 through 6 show a box-shaped connector assembly 40 according to the present invention. The connector assembly 40 comprises a module type male connector unit 41 with a layer structure and a female connector 43 as shown in FIG. 5, and the male connector unit 41 comprises a plurality of laminar housings 45*a*, 45*b* and 45*c*. FIG. 4 shows the housings 45*a*, 45*b* and 45*c* in a separated state before forming the male connector unit 41, and FIG. 5 shows a unified state where the housings 45*a*, 45*b*, and 45*c* are attached one another into the male connector unit 41. The module type male connector unit 41 unified is inserted into a hood 47 of the female connector 43 to establish electrical connection between each pair of male and female terminals, as shown in FIG. 6. In FIGS. 4 through 6, an arrow A represents an insertion direction along which the male connector unit 41 is longitudinally inserted into the female connector 43.

In detail, the male connector unit 41 comprises the first housing 45*a* which is utilized for an uppermost layer, the second housing 45*b* for an intermediate layer, and the third housing 45*c* at a lowermost layer. Each of the housings is divided by partition walls 49 into a plurality of terminal receptacles 51 of an elongated shape. The terminal receptacles 51 in each housing are arranged in parallel along an insertion direction A of the male connector unit 41 to form a single layer. A female terminal 53 for press-contact connection is mounted in each terminal receptacle 51. As shown in FIG. 6, a cavity 55 extends in the front part of each terminal receptacle 51. An electrical contact of the female terminal 53 is accommodated in the cavity 55 and secured by a lance 57. An upper surface of each of the terminal receptacles 51 is opened at the rear part thereof for mounting the female terminal 53.

Referring to FIG. 4, a pair of a coupling plate 59 and a coupling projection 61 is formed at each of four corners of the housings 45*a*, 45*b*, and 45*c* for establishing connection between each adjacent pair of the upper and the lower housings. Specifically, in each of the two front corners, the coupling projection 61 is formed in a recessed portion at the lower part of the corner of the upper housing and projects outwards along the insertion direction A. The coupling projection 61 is coupled with a coupling hole 63 of the coupling plate 59 upwardly extending from the upper corner of the lower housing. On the other hand, in each of the two rear corners, the coupling projection 61 projects outwards in the lateral direction of the connector from the lower part of a side wall of the upper housing in the vicinity of the corner. The coupling projection 61 is coupled to the coupling hole 63 of the coupling plate 59 upwardly extending from the upper rear part of a side wall of the lower housing in the vicinity of the corner. Thus, the housings 45*a*, 45*b*, and 45*c* are fixed to one another in a unified state, as illustrated in FIG. 5. In FIG. 5, the referential letter H represents a total height along a superposing direction when the housings 45*a*, 45*b*, and 45*c* are superposed and attached.

In FIG. 4, the first housing 45*a* which is located at the outermost, or, uppermost position along the superposing direction is different in structure from the other housings inasmuch as the first housing 45*a* has a portion where no terminal receptacle 51 is formed. Specifically, the terminal receptacles 51 of the first housing 45*a* are separately located at the left and right sides, and a central base plate 65 having a predetermined thickness h interposes between the terminal receptacles 51. Accordingly, the level of the upper surface of the first housing 45*a* is lowered at the central base plate 65 to form a cavity. In this cavity, a locking mechanism is arranged to lock the male connector unit 41 to the female connector 43.

The locking mechanism includes a mounting end portion 67 and an arm 69 extending therefrom. The mounting end portion 67 stands up from a substantially central portion of an upper front end of the base plate 65, and extends substantially perpendicularly to the base plate 65, or, substantially in parallel to the superposing direction. The arm 69 then extends from the mounting end portion 67 towards a direction reverse to the insertion direction A along the base plate 65 at an approximately constant interval from the base plate 65. The upper surface of the arm 69 is leveled with an approximately identical level of top walls of the terminal receptacles 51. In this structure, a front end portion of the arm 69 is supported by the mounting end portion 67 while a rear end 71 is a free end which can be moved. Moreover, the arm 69 is provided with an engagement projection 73 on the upper surface thereof, and, if the male connector unit 41 is inserted into the female connector 43, the engagement projection 73 is engaged with an engagement portion 75 which is recessed on the upper wall of the female connector 43, thereby the male connector unit 41 is locked in the female connector 43. Moreover, a press protrusion 77 is formed at the rear end 71 of the arm 69. When the press protrusion 77 is pressed, the arm 69 is elastically bent down to release engagement between the engagement projection 73 and the engagement portion 75 to unlock the male connector unit 41 and the female connector 43 from each other. It becomes thus possible to remove the male connector unit 41 from the female connector 43.

Moreover, the connector assembly according to the present invention has holding means for tightly holding the uppermost male housing with respect to another male housing attached adjacent to the uppermost one in order to prevent the base plate 65 from being deformed due to a pressing force exerted during unlock operation. The holding means comprises a coupling protrusion 79 formed on the mounting end portion 67, and a coupling piece 81 standing up from a front end of the top wall of the second housing 45*b* which is downwardly adjacent to the first housing 45*a*. The coupling protrusion 79 is arranged in a recessed portion which is formed at the front of the mounting end portion 67. When the first and the second housings 45*a* and 45*b* are superposed together, the coupling protrusion 79 and a coupling hole 83 formed on the coupling piece 81 of the second housing 45*b* are interengaged with each other. Once the coupling protrusion 79 and the coupling hole 83 are coupled together, the mounting end portion 67 and the base plate 65 of the first housing 45*a* are firmly fixed on the second housing 45*b* and tightly held. Therefore, the base plate 65 is prevented from being upwardly deformed when the press protrusion 77 of the arm 69 is pressed down.

Furthermore, the first housing 45*a* at the uppermost position is formed so that a pair of covers 85 are attachable to the opened portion of the upper wall of the terminal receptacles 51. Specifically, each cover 85 has a pair of coupling plates 87 provided with coupling holes 89. On the other hand, the first housing 45*a* has ratchets 91 for attachment of the covers 85 at the upper and rear ends of the side walls. Each of the ratchets 91 is fitted into the corresponding coupling hole 89 of the cover 85 to engage the coupling plate 87. In addition, a pair of engagement protrusions 93 are formed at a front end of each cover 85 to be engaged with a rear end of the upper wall of the first housing 45*a*.

The male connector unit 41 having the above-mentioned structure is used as follows.

Initially, referring to FIG. 6, the female terminal 53 is mounted in each terminal receptacle 51 of each housing. Each wire of a wire harness is connected to each terminal 53 by the use of a press-contact apparatus (not shown).

Next, as shown in FIG. 5, the housings 45*a*, 45*b*, and 45*c* are superposed together. The coupling projection 61 and the coupling hole 63 at each corner are coupled to each other while the reinforcement coupling piece 81 and the coupling protrusion 79 are coupled together. Thus, the housings are attached together and unified into a male connector unit. Then, the covers 85 are attached to the male connector unit 41. Thus, assembling of the male connector unit 41 is completed.

After the above-described assembling, the male connector unit 41 is inserted into the hood 47 of the female connector 43, as shown in FIG. 6. At this time, the engagement projection 73 of the arm 69 is brought into contact with the hood 47 to elastically bend the arm 69 in a downward direction depicted by an arrow B in FIG. 6. When the engagement projection 73 is received by a receiving portion 95 of the hood 47, the arm 69 is recovered into an original state to engage the engagement projection 73 to the engagement portion 75. In this state, male terminals 97 of the female connector 43 are respectively inserted into electrical contacts 99 of the female terminals 53 of the male connector unit 41 to make electrical connection therebetween.

In order to remove the male connector unit 41 from the female connector 43, the press protrusion 77 is pressed towards a direction depicted by an arrow B to bend the arm 69, as illustrated in FIG. 6. The engagement projection 73 of the arm 69 is then released from the engagement portion 75 of the female connector 43. In this state, the male connector unit 41 is pulled out from the female connector 43.

In the connector assembly of the above-mentioned structure, since the arm 69 is supported only at its one end portion, the arm 69 is easily bent by a small force and easily operated to release the locking. Therefore, connection and disconnection of the connector assembly are readily carried out. It is noted that, when the press protrusion 77 is pressed in the direction B, a reactive force is applied on the base plate 65 via the mounting end portion 67 in a reverse direction which is depicted by an arrow C in FIG. 6. However, the reactive force is blocked by engagement of the coupling protrusion 79 formed on the mounting end portion 67 with the coupling hole 83 of the coupling piece 81 formed on the lower housing. Therefore, the mounting end portion 67 and the base plate 65 are prevented from floating up. According to the above construction, a provision of the coupling piece 81 and the coupling protrusion 79 serves to compensate a material intensity of the base plate 65 and to alleviate a load applied on the base plate 65. Even if the thickness h of the base plate 65 is reduced, the base plate 65 is reinforced and hardly deformed. As a result, the base plate 65 never floats up separately from the adjacent lower housing in the direction C. It is thus possible to prevent assembling and disassembling of the male and female connectors from being undesirably inhibited. Since the thickness h of the base plate 65 can be reduced, the whole height H can be reduced also. As a result, reduction of a size of the connector assembly can be achieved.

In the foregoing embodiment, the male connector unit 41 has a triple-layer structure. However, the number of layers is not restricted at all. In order to increase the number of layers, the number of the second housings 45*b* is increased. In this case, additional second housings 45*b* is not provided with the coupling piece 81. In a case of employing a double-layer structure, the second housing 45*b* is omitted and the third housing 45*c* at the lowermost position is provided with the coupling piece 81. Thus, the multi-layer connector according to the present invention includes any desired plural number of layers.

In the foregoing embodiment, the press-contact connector is described. However, the present invention is also applicable to various types of connectors other than the press-contact type.

As mentioned above, it must be understood that the invention is in no way limited to the above embodiments and that many changes may be brought about therein without departing from the scope of the invention as defined by the appended claims.

What is claimed is:

1. A connector assembly, comprising:

a plurality of male housing modules which are separable from each other and attached together to form a male housing unit, each of the male housing modules having at least one male housing module terminal;

a female housing adapted to receive the male housing unit to be inserted into the female housing, the female housing having female housing terminals to be electrically connected with at least one male housing module terminal of each of the male housing modules;

locking means for releasably locking the male housing unit with respect to the female housing, the locking means being mounted on an outermost one of the male housing modules; and holding means for tightly holding the outermost male housing module with respect to another one of the male housing modules attached adjacent to the outermost male housing module in a direction transverse to an inserting direction into the female housing;

wherein the outermost male housing module includes a mounting portion to which the locking means is mounted, the holding means holding the mounting portion to another one of the male housing modules to prevent separation of the male housing modules during operation of the locking means.

2. The connector assembly of claim 1, wherein the holding means includes a couple of interengaging devices to be engaged with one another, one of the interengaging device is provided on said outermost one of the male housing modules, and the other of the interengaging device is provided on said another one of the male housing modules attached adjacent to the outermost one of the male housing modules.

3. The connector assembly of claim 2, wherein said one of the interengaging devices is a projection, and the other of the interengaging devices is a coupling piece having a hole to receive the projection.

4. The connector assembly of claim 1, wherein the locking means comprises an elongated locking arm and a couple of locking engagement devices, the locking arm having a mounting end portion at which the locking arm is elastically mounted on the outermost one of the male housing modules in such a manner that the locking arm can be elastically operated, one of the locking engagement devices being provided on the locking arm and the other of the locking engagement devices being provided on the female housing so that the locking engagement devices are engaged with and disengaged from each other by elastically operating the locking arm when the male housing unit is inserted in the female housing.

5. The connector assembly of claim 4, wherein the locking arm has another end portion opposite to the mounting end portion and movable relative to the male housing unit, and the locking arm is elastically operated by pressing said another end portion of the locking arm.

6. The connector assembly of claim 5, wherein the locking arm extends from the mounting end portion to said another end in a direction reverse to an insertion direction along which the male housing unit is inserted into the female housing.

7. The connector assembly of claim 1, wherein the male housing unit is inserted into the female housing along a longitudinal direction, each of the male housing modules includes a laminar housing, and the laminar housings of the male housing modules are superposed and aligned with each other in parallel to the longitudinal direction.

8. The connector assembly of claim 7, wherein each of the laminar housing has an opening for installing said at least one male housing module's terminal in said each of the laminar housing.

9. The connector assembly of claim 8, wherein the opening is formed on an upper rear portion of each of the laminar housings in such a manner that the opening of one of the laminar housings can be covered with another one of the laminar housings which is superposed on said one of the laminar housings.

10. The connector assembly of claim 9, further comprising a cover plate for covering the opening of the uppermost one of the laminar male housings superposed to form the male housing unit.

11. The connector assembly of claim 7, wherein the male housing modules have a number of coupling means each for tightly coupling a pair of the laminar male housings which are adjacently aligned each another.

12. The connector assembly of claim 11, wherein each of the coupling means includes a couple of a coupling projection and a coupling plate with a hole to receive the coupling projection, the coupling projection is formed on one of said pair of the laminar male housings, and the coupling plate is formed on the other of said pair of the laminar male housings.

13. A connector assembly, comprising:

a plurality of male housing modules which are separable from each other and attached together to form a male housing unit, each of the male housing modules having at least one male housing module terminal;

a female housing adapted to receive the male housing unit to be inserted into the female housing, the female housing having female housing terminals to be electrically connected with at least one male housing module terminal of each of the male housing modules;

locking means for releasably locking the male housing unit with respect to the female housing, the locking means being mounted on an outermost one of the male housing modules; and holding means for tightly holding the outermost one of the male housing modules with respect to another one of the male housing modules attached adjacent to the outermost one of the male housing modules;

wherein the holding means holds a portion of the outermost one of the male housing modules at which the locking means is mounted on the outermost one of the male housing modules, said portion being located at a substantially central and front portion of the outermost one of the male housing modules.

14. A connector assembly, comprising:

a plurality of male housing modules which are separable from each other and attached together to form a male housing unit, each of the male housing modules having at least one male housing module terminal;

a female housing adapted to receive the male housing unit to be inserted into the female housing, the female housing having female housing terminals to be electrically connected with at least one male housing module terminal of each of the male housing modules;

locking means for releasably locking the male housing unit with respect to the female housing, the locking means being mounted on an outermost one of the male housing modules; and holding means for tightly holding the outermost male housing module with respect to another one of the male housing modules attached adjacent to the outermost male housing module;

wherein the holding means includes a couple of interengaging devices to be engaged with one another, one of the interengaging devices being provided on said outermost male housing module, and the other interengaging device being provided on another male housing module adjacent to the outermost male housing module; and wherein one of said interengaging devices is a projection and the other interengaging device is a coupling piece having a hole to receive the projection.

* * * * *